United States Patent [19]

Phelps

[11] 4,317,480

[45] Mar. 2, 1982

[54] INSULATING WINDOW BLIND

[76] Inventor: N. Eric Phelps, 16060 NE. 165th St., Woodinville, Wash. 98072

[21] Appl. No.: 157,466

[22] Filed: Jun. 9, 1980

[51] Int. Cl.[3] ..... E06B 9/08; E06B 9/20

[52] U.S. Cl. ..... 160/23 R; 160/267 R; 160/269; 160/290 R; 160/DIG. 16

[58] Field of Search ..... 160/269, 268 R, 268 S, 160/270, 290 R, 266, 267 R, 23 R, DIG. 16, 98, 264, 285, 299, 380

[56] References Cited

U.S. PATENT DOCUMENTS

| | | | |
|---|---|---|---|
| 2,537,611 | 1/1951 | Walton | 160/264 |
| 2,548,041 | 4/1951 | Morse | 160/269 X |
| 3,292,685 | 12/1966 | Clark | 160/264 X |
| 3,583,465 | 6/1971 | Youngs et al. | 160/264 |
| 4,126,174 | 11/1978 | Moriarty et al. | 160/266 |
| 4,220,189 | 9/1980 | Marquez | 160/269 X |

*Primary Examiner*—Rodney H. Bonck

*Attorney, Agent, or Firm*—Seed, Berry, Vernon & Baynham

[57] ABSTRACT

A protective cartridge mounted to a window frame has a retractable roll of blind material mounted therein. Loose steel tapes, not fastened to the blind material, are rolled with the blind material and space apart the convolutions of the rolled blind material. The blind material when extended is sandwiched between the steel tapes and magnetic strips fastened to tracks along the margins of the window frame to provide an airtight seal. The top of the blind is sealed against a rub strip portion of the cartridge and the lower portion of the extended blind material is sealed against a window sill to provide a trapped insulating air layer between the window and the blind when the blind is fully extended. Drag is bidirectionally exerted against the steel tapes to tension and position the tapes to lie flat against the blind when extended or to smoothly lie between convolutions of the rolled blind material. A combination centering guide and locking mechanism is provided at the lower end of the blind material.

16 Claims, 12 Drawing Figures

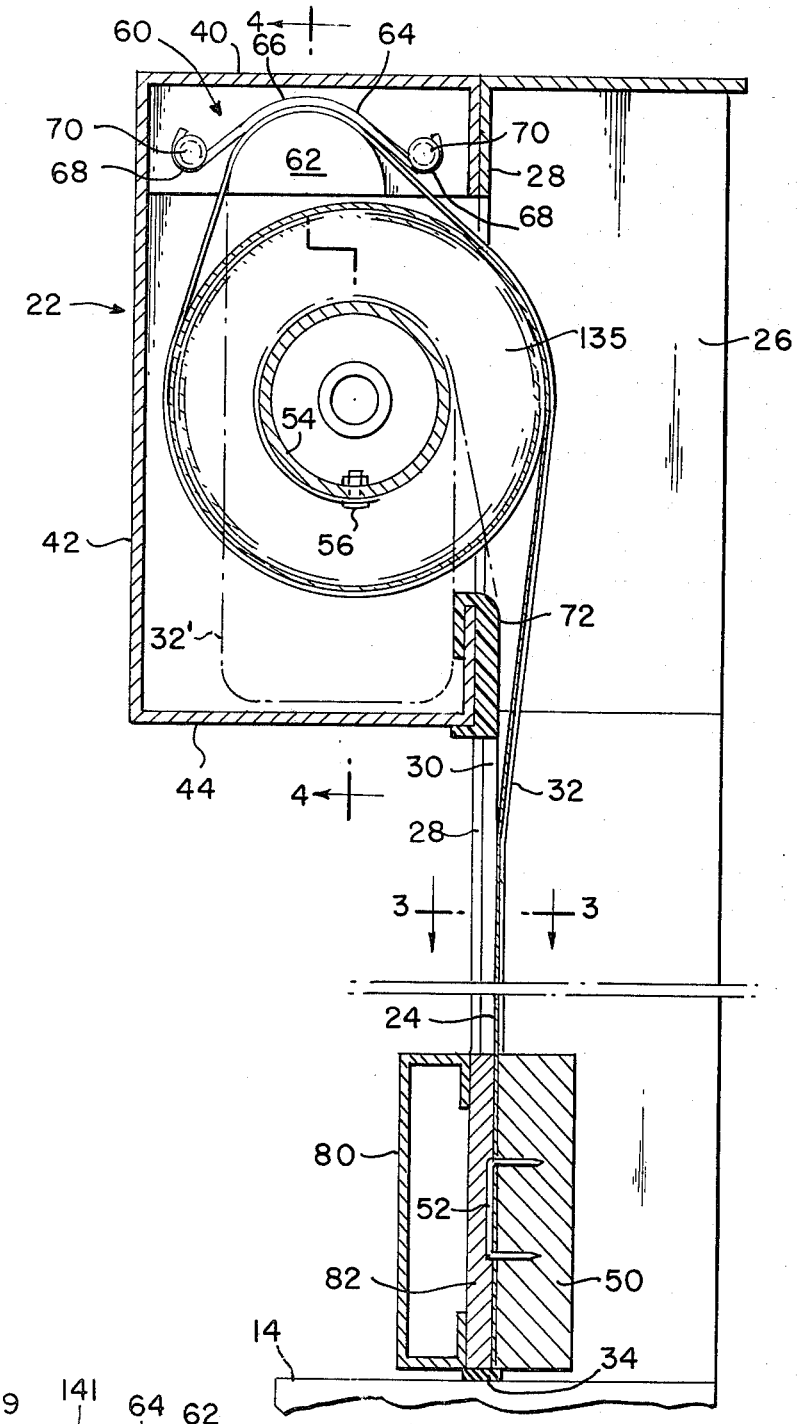
FIG. 2
FIG. 3
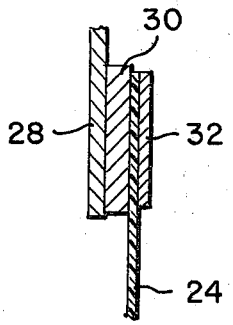
FIG. 4
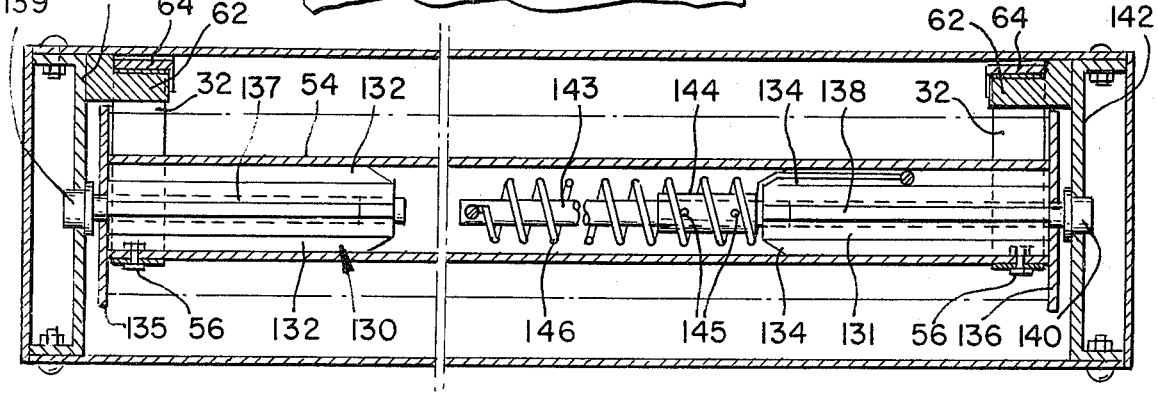

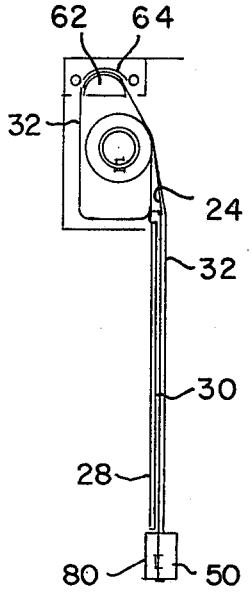
FIG. 5
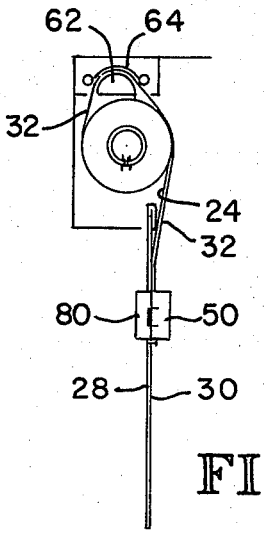
FIG. 6
FIG. 7
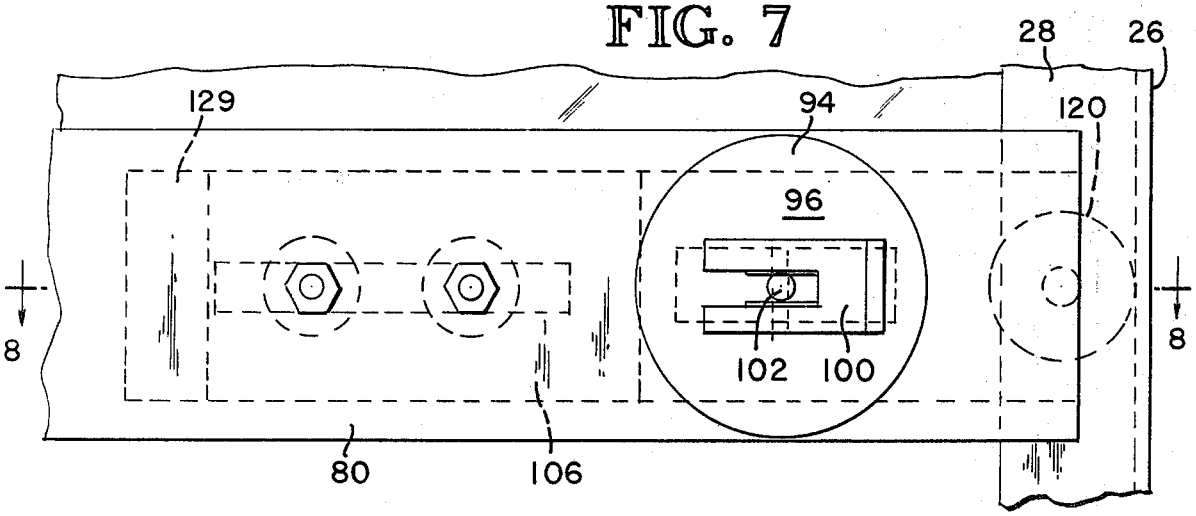
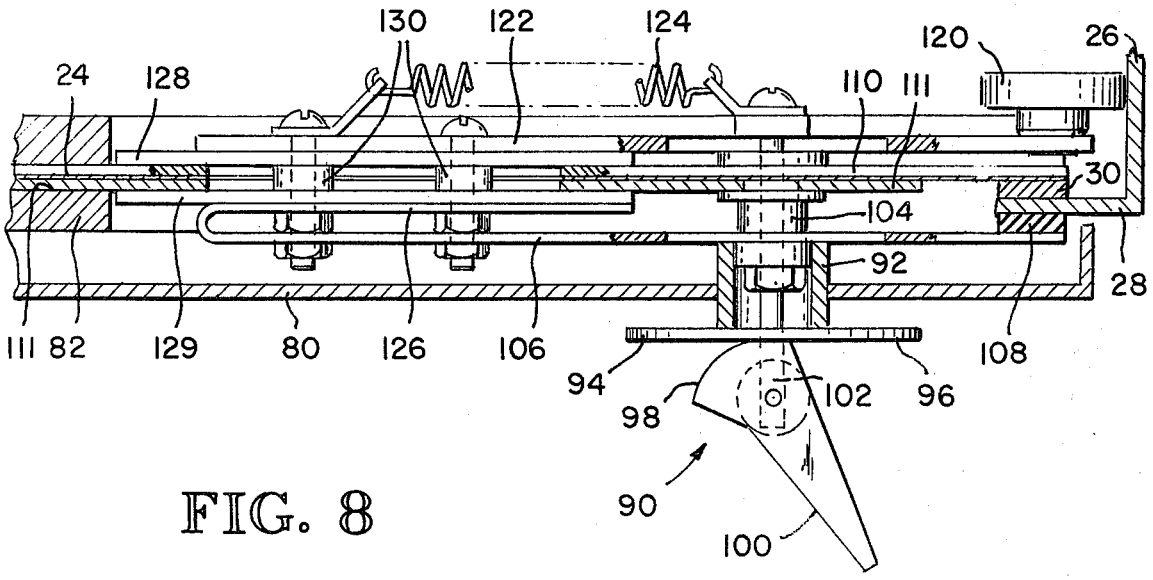
FIG. 8

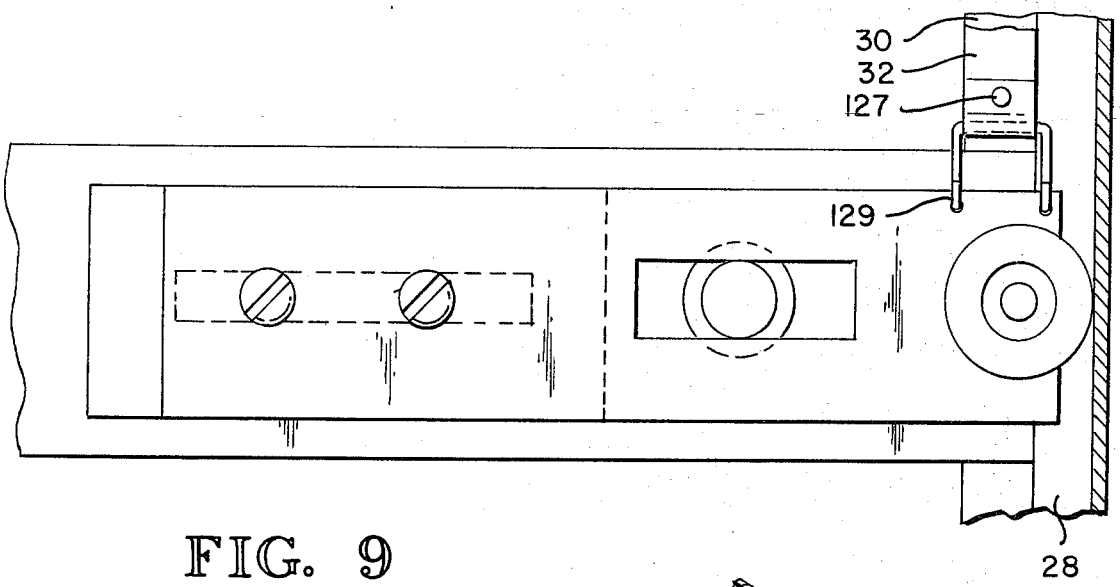
FIG. 9
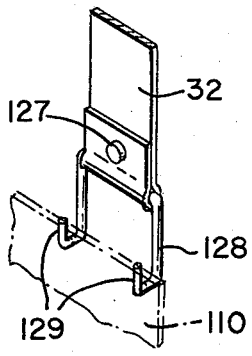
FIG. 10
FIG. 11
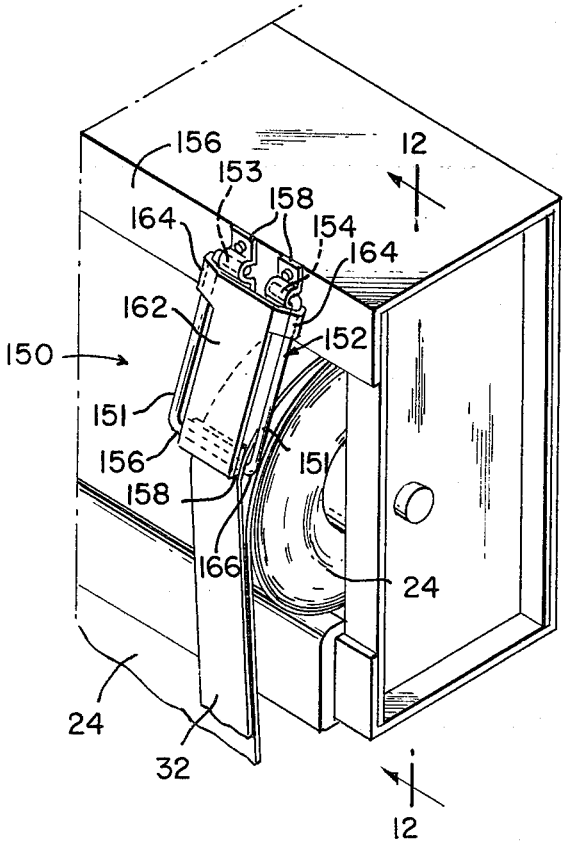
FIG. 12
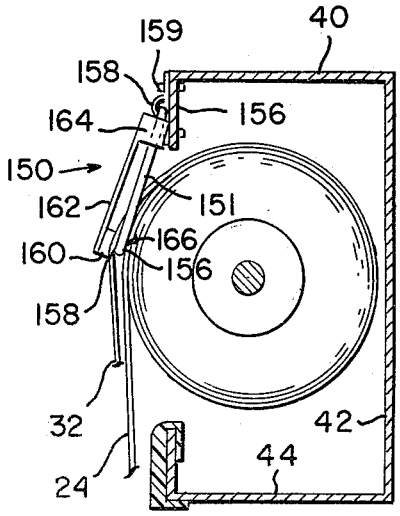

INSULATING WINDOW BLIND

BACKGROUND OF THE INVENTION

1. Field of the Invention

This invention relates to improved insulating window blind or shade assemblies.

2. Prior Art Relating to the Disclosure

Various systems for clamping a sheet of shade or blind material in a spaced-apart relationship over a window are known. For example, U.S. Pat. No. 2,548,041 discloses a housing positioned at the top of a window frame for retractable rolls of sheet or screen material. The edges of the sheet or screen material are sealed against the window frame by elongated hinged plates. Other types of window shades utilize steel strips which are directly bonded to the shade material near its outer edges and which are sealed to a frame adjacent the window by corresponding magnetic strips. Shades which are made of plastic material such as Mylar have problems with maintaining the bond between the steel strips and the plastic material to maintain an airtight seal.

SUMMARY OF THE INVENTION

It is therefore an object of the invention to provide an insulating blind assembly which provides an airtight seal in its extended position over a window frame.

It is another object of the invention to provide an insulating blind assembly which utilizes magnetically attraction so that loose sealing tapes are not required to be bonded to the blind material.

It is another object of the invention to provide an insulating blind assembly which includes a cartridge container for the roll of insulating material which protects the retracted insulating material from dirt and the like.

It is another object of the invention to provide magnetic sealing using loose steel tapes which are hidden from view behind trim strips.

In accordance with these and other objects of the invention, an insulating blind assembly for a window or the like is provided according to one aspect of the invention with a closed cartridge surrounding and protecting a roll of blind material, which cartridge provides an airtight seal at the top of the roll when the roll is fully extended. The invention also includes steel tapes which are commonly rolled with the blind material along the lateral edges of the material so that the convolutions of the blind material are spaced apart to prevent abrasion therebetween. The steel tapes are not fixed to the blind material except at the top where both are fastened to a roller. At the bottom of the blind, the tape is fastened to a batten. Tracks along the sides of a window have magnetic strips fastened thereto so that the edges of the blind material are sealed by the steel tape being magnetically drawn to the magnetic tape. In its broadest form, however, the loosely connected steel tape where sufficiently rigid can press the blind material against the tracks without the use of magnetic material. In the preferred embodiment, the batten end of the roll is sealed with a sealing strip and the entire blind assembly provides an insulating layer of air adjacent the window. The batten in one embodiment includes a mechanism for locking the batten in various positions along the track. Bidirectional drag mechanisms are provided on the assembly which cause the steel tape to smoothly lie against the blind material when the blind material is extended and which cause the tape to lie flat between the convolutions of a retracted roll of blind material. The magnetic strips are positioned such that the steel tapes are not readily visible.

BRIEF DESCRIPTION OF THE DRAWINGS

FIG. 2 is a broken sectional view of the blind assembly taken along section line 2—2 of FIG. 1;

FIG. 3 is a detailed sectional view of a portion of a blind assembly taken along section line 3—3 of FIG. 2;

FIG. 4 is a sectional view of a roller for a blind assembly taken along section line 4—4 of FIG. 2;

FIG. 5 is a schematic view of a blind assembly showing the roll of blind material in a fully extended position;

FIG. 6 is a schematic view of a blind assembly showing the roll of blind material in a retracted position;

FIG. 7 is a detailed front elevation view of a lock and guide assembly for the end of the roll of blind material;

FIG. 8 is a sectional view of the guide and lock assembly taken along section line 8—8 of FIG. 1.

FIG. 9 is a detailed rear elevation view of the lock and guide assembly at the end of a roll of blind material;

FIG. 10 is an isometric view of the hook assembly at the end of the steel tape;

FIG. 11 is a perspective view of an alternative drag mechanism for the steel tape; and FIG. 12 is a side elevation, partially sectional view of the drag mechanism of FIG. 11.

DETAILED DESCRIPTION OF THE PREFERRED EMBODIMENT

Figure 1:
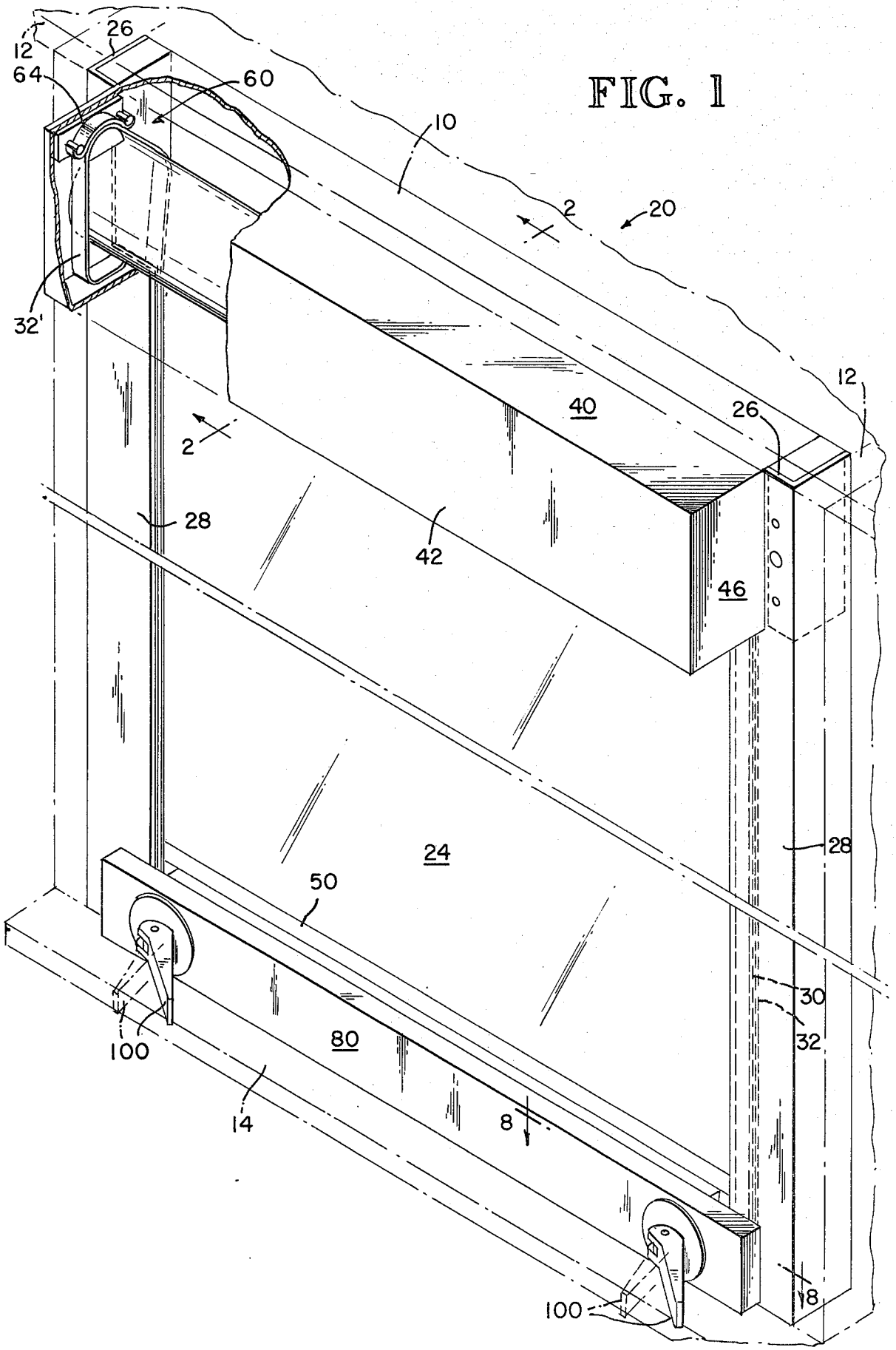
FIG. 1 is a perspective view of an insulating window blind assembly according to the invention.

Referring now to FIG. 1 of the drawings, a window opening is defined by elements shown in phantom which include a window frame top plate 10, window frame side members 12 vertically extending on each side of the opening, and a windowsill 14 along the bottom of the window opening. An insulating blind assembly 20 has a cartridge assembly 22, shown in FIGS. 1 and 2, which surrounds and protects a roll of blind material 24, such as clear or tinted Mylar sheet material, which is soft and subject to abrasion by dust particles and the like so that the closed cartridge assembly provides protection for the rolled up blind material.

Attached to each of the window frame side members 12 are L-shaped tracks 26. Each of the tracks 26 has a front flange portion 28, as shown in FIG. 1, which lies parallel to the plane of the window opening. Secured along the rear face of each of the front flanges 28 are permanently magnetized, or magnetic, strips 30, as shown in FIG. 2. The cartridge assembly 22 also dispenses rolled-up steel tapes 32 which are not connected or fixed to the blind material 24, but are loose and are positioned to lie along the surface of the blind material such that the steel tapes 30, being ferromagnetic, are attracted to the magnetic strips to sandwich the underlying portions of the blind material therebetween, as shown by FIGS. 2 and 3. A resilient strip 34 of suitable material, such as felt, rubber or plastic provides a seal between the bottom of the blind assembly 20 and the window sill 14. Sealing means are also provided at the top of the blind so that an insulating layer of air is trapped between the blind material 24 and the glassed window surface when the blind is fully extended.

The cartridge assembly 22 is a rectangular enclosure having a top wall 40, a front wall 42, a bottom wall 44, and side walls 46. The cartridge assembly 22 is mounted near the top of the tracks 26 and extends horizontally across the top margin of the window opening, as shown in FIG. 1. Referring to FIG. 2, the free lower end of the rolled blind material 24 is fastened to a wooden batten 50 by staples 52. The ends of the steel tape 32 and the top end of the blind material 24 are fastened to the outside surface of a hollow aluminum roller tube 54 using suitable fasteners, such as rivets 56. No other attachment of the steel tape 32 is made to the blind material 24.

The solid lines of FIG. 2 show the blind material 24 and the steel tape 32 in a retracted position; i.e., a position in which the blind material 24 and the steel tape 32 are rolled up around the aluminum tube 54 such that the steel tape interleaves with the convolutions of the blind material 24 and the tape thickness provides spacing between the blind material, preventing contact and abrasion of the blind surface. The phantom lines of FIG. 2 showing the steel tape 32' when the blind is in its fully extended position. The steel tape is wrapped outside the blind material so that the length of the steel tape 32 is somewhat longer than the length of the blind material 24. The excess length of the steel tape 32' when the blind is fully extended is accumulated within the cartridge by one embodiment of a bidirectional drag mechanism 60 shown in FIGS. 1 and 2. The drag mechanism 60 is mounted as shown to the side walls 46 of the cartridge or externally of the cartridge, if required. The drag mechanism 60 includes a halfround nylon block 62 and a resilient friction clip 64 having a central arcuate portion 66 which is biased toward the exterior surface of the nylon block 62. The friction clip 64 is a resilient arcuate strip having reversely bent ends 68, each of which wraps around a respective one of a pair of pins 70. A steel tape 32 passes between the inside surface of the friction clip 64 and the exterior surface of the nylon block 62 such that a frictional drag force is exerted upon the steel tape 32. The drag is bidirectional and is exerted on the steel tape when it is being either retracted or extended. When the steel tape 32 is extended from the cartridge, slack is taken up by the drag mechanism 60 such that the steel tape 32 lies smoothly against the extended blind material for a tight seal of the blind material 24 being drawn against the magnetic strips 30 and the excess tape forms a loop 32'. When the steel tape 32 is retracted into the cartridge assembly 22, the drag mechanism 60 causes the steel tape 32 to bunch up prior to being rolled in an interleaved fashion so that the steep tape and the sheet material can smoothly interleave. FIGS. 5 and 6 show, respectively, the tape 32 and the blind material 24 in the extended and the retracted positions. The rear wall of the cartridge assembly 22 has a lower lip portion which has attached thereto a snap- on nylon rub bar 72. When the blind material 24 is fully extended, it engages the outside surface of the rub bar 72 and provides a seal at the top end of the blind material so that the air is trapped between the glassed surface of the window and the blind material 24 overlying the window opening.

FIGS. 7, 8 and 9 show mechanisms for centering the lower end of a roll of blind material 24 and the steel tapes with respect to the tracks 26. The lower end of the blind is clamped or locked in various positions along the tracks 26 by clamps also provided at the lower end of the roll. A trim panel 80, shown in FIGS. 1 and 2, is fixed to the front lower edge of the roll of blind material 24. A spacer strip 82 is positioned between the trim panel 80 and the batten 50. The blind material 24 is near the batten and is sandwiched between two plates 110, 111 as shown in FIG. 8.

A clamp mechanism 90 fixed to the trim panel 80 includes a hollow cylindrical sleeve 92 extending perpendicularly through an aperture in the trim panel 80. A disk 94 fixed to the cylindrical sleeve's outer end and the exterior surface 96 of the disk 94 is engaged by a cam surface 98 formed at one end of a cam lever 100. The cam lever 100 is pinned to a shaft 102 which extends through an aperture in the disk 94 and is connected to a cylindrical plug 104 one end of which fits coaxially within the interior of the cylindrial member 92. A spring plate 106 having one reversely bent end is mounted for lateral movement near the end of the blind. The free end of the spring plate 106 has a rubber pad 108 mounted thereupon which engages the front face of the flange 28. The end of the plate 110 engages the Mylar adjacent the magnetic strip 30 attached to the rear surface of the flange 28. The cam lever 100 is operated to clamp the blind at various positions along the flanges 28.

A roller 120 is mounted to move laterally with a plate 122 which is biased by a spring 124 connected to the clamp assembly 90. The roller 120 engages the track member 26 and positions the end of the steel tape 32 attached thereto in alignment with the magnetic strip. The plate 122 and the spring plate 106 slide with respect to the plates 110, 111 and the sheet material 24 using a pair of rectangular nylon plates 128, 129 which are respectively positioned, as shown in FIG. 8, between the plates 122, 110 and also between the reversed arm 126 of the spring 106 and the plate 111. Rollers 130 mounted to the laterally movable components roll in slots formed in the plates 110, 111. Springs 124 bias the trim panel and thus the sheet material 24 into a centered position. As shown in FIG. 10, the ends of the steel strips are reversely bent and fastened with rivets 127 around the center connecting shank of a double-armed hook assembly 128 formed from heavy wire. Reversely bent hooks 129 engage corresponding holes formed in the laterally movable plate 122 as shown in FIG. 9.

FIG. 4 shows the hollow roller tube 54 mounted within the cartridge. A pair of nylon plugs 130, 131, having radially extending longitudinal ribs 132, 134, are pressed in the respective ends of the roller tube 54. Each plug has an end flange 135, 136. Axles 137, 138 extend through respective plugs and are journaled by bearings 139, 140 mounted on support brackets 141, 142 mounted to the cartridge. The axle 138 is fixed with respect to the cartridge and an axially extending extension rod 143 is fixed to the inside end of the axle 138 using a cylindrical sleeve coupling 144 and drive pins 145. A coil spring 146 extends around the extension rod 143 and has one end fixed to the extension rod 143 and an extending hook portion at the other end engaging the plug 131. As the roller tube 54 is rotated by drawing the blind material 24 from a fully retracted configuration, the spring 146 provides a retracting, or rewinding, force for the blind material 24 to draw the blind material back into the cartridge. The cam levers 100 are operated to clamp the lower end of the blind at various positions along the tracks and permit the window to be opened if desired.

FIGS. 11 and 12 shown an alternative embodiment of another bidirectional drag mechanism 150 for each steel tape 32. The mechanism 150 includes a rectangular yoke 152 formed from resilient heavy wire. The yoke has two parallel-spaced side arms 151 which are each pivotally attached at one end by a pair of inwardly bent leg portions 153, 154 which are hinged to the upper rear wall 156 of a cartridge 22 by suitable means, such as hinge brackets 158 which are fastened to the wall 156 by rivets 159. The brackets 158 have a raised center area forming a socket in which one of the legs 153, 154 pivots in a vertical plane near the edge of a roll of blind material 24. A cross-member 156 extends between the free ends of the arms 152. The outside surface 158 located away from the roll 24 serves as a drag surface for one side of a steel tape 32. The steel tape 32 is biased against the surface 158 by a friction pad 160, which is formed from hard rubber or the like and which also provides drag to the opposite side of the steel tape 32. The friction pad 160 is fixed to one end of a resilient pressure plate 162. Reversely bent tabs 164 are bent around the yoke arms 151 near the legs 153, 154 so that the friction pad 160 is biased by the pressure plate 162 toward the yoke cross-member 156. The steel tape 32 is extended or retracted from its interleaved position on the roll such that, in both cases, a polished inside surface 166 of the cross-member 156 is lightly pushed against the surface of the sheet material 24 to exert a slight drag against the roll of sheet material 24 as it is rotated. The drag mechanism 150 exerts drag against the steel tape 32 as it moves in either direction.

The particular embodiments and methods of the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. An insulating blind assembly for a window, comprising:

a retractable roll of blind material having its free end sealable against the window sill;

a cartridge surrounding and protecting the roll of blind material and providing an airtight seal at the top of the roll when the roll is fully extended;

steel tapes rolled onto and with the blind material at the lateral edges thereof to provide spacing between convolutions of the rolled blind material, said tapes fixed with respect to the blind material only at the opposite ends of the tapes;

tracks adapted to being positioned along the side margins of a window frame or the like; and magnetic strips fastened along the tracks, said steep tape being attracted to the magnetic strips to sandwich portions of the roll of blind material therebetween to form an airtight seal against the magnetic tape whereby the window blind assembly traps an insulating layer of air between itself and the window in the fully extended position of the blind.

2. The blind assembly of claim 1, including a batten fixed to the end of the roll of blind material to facilitate retraction and extension of said blind material and including means for locking the batten in various extended positions.

3. The blind assembly of claim 1, inclduing means for exerting a bidirectional drag on the steel tapes as they are being either retracted or extended so that as the blind material is extended, the tapes lie smoothly against the blind material and so that the steel tapes lie smoothly against the blind material within the retracted roll.

4. The blind assembly of claim 1, wherein the magnetic strip is positioned behind the tracks so that it is not readily visible from the front of the tracks.

5. The blind assembly of claim 1, including a common rolling mechanism for the blind material and the steel tapes which interleaves the steel tapes between convolutions of the blind material.

6. The blind assembly of claim 2, including means mounted to the batten for guiding the lower end of the roll and the ends of the steel tapes between the tracks.

7. The blind assembly of claim 2, including clamp means for locking the batten in various positions along the tracks.

8. The blind assembly of claim 1, wherein the retractable roll of blind material is mounted for rotation within the cartridge with the cartridge having a rub strip portion which engages a portion of the fully extended roll of blind material to seal the top of the roll.

9. A insulating blind assembly for a window or the like, comprising:

a retractable roll of blind material;

means for sealing the roll when extended at the top of a window;

separate loose magnetically attracted tapes which are carried freely of the blind material of the roll and which are rolled with the blind material to interleave therewith and to space apart the convolutions of the rolled blind material;

fixed strips positioned along the window adjacent the extended blind material; and means for magnetically attracting the loose tapes to the fixed strips so that unrolled blind material is sandwiched therebetween to form a seal whereby the blind, when extended, traps a layer of air between itself and the window.

10. The assembly of claim 9, including a cartridge surrounding and protecting the roll of retracted blind material, said cartridge having a rub strip against which the roll is sealed when extended.

11. The assembly of claim 9, wherein the fixed strips are positioned such that the loose tapes are not readily visible when sandwiching the blind material.

12. The assembly of claim 9, including means for exerting a bidirectional drag on the loose tapes as they are being retracted or extended so that the tapes lie smoothly against the blind material when extended and so that the tapes lie smoothly against the blind material in the retracted roll.

13. The assembly of claim 9, including means for locking the blind material in various unrolled positions along the fixed strips.

14. The assembly of claim 9, wherein the tapes are ferromagnetic and the strips include magnetized portions.

15. An insulating blind assembly for a window, comprising:

a retractable roll of blind material having its free end sealable against the window sill;

means rotatably supporting the roll and providing an airtight seal at the top of the roll when the roll is fully extended;

clamping tapes rolled onto and with the blind material at the lateral edges thereof to provide spacing between convolutions of the rolled blind material, said tapes attached to the blind material only at the opposite ends of the tapes;

tracks adapted to being positioned along the side margins of a window frame or the like; and means pressing the clamping tapes against the blind material toward the tracks to sandwich portions of the roll of blind material therebetween to form an airtight seal against the tracks whereby the window blind assembly traps an insulating layer of air between itself and the window in the fully extended position of the blind.

16. The blind assembly of claim 15, said pressing means including magnetic strips attached to said tracks.

* * * * *